US011759852B2

(12) United States Patent
Kajita et al.

(10) Patent No.: US 11,759,852 B2
(45) Date of Patent: Sep. 19, 2023

(54) INSTALLATION STRUCTURE FOR DIE CASTING SLEEVE, AND DIE CASTING SLEEVE

(71) Applicant: TYK CORPORATION, Tokyo (JP)

(72) Inventors: Shinji Kajita, Tajimi (JP); Yukie Kaku, Tajimi (JP)

(73) Assignee: TYK CORPORATION, Tokyo (JP)

( * ) Notice: Subject to any disclaimer, the term of this patent is extended or adjusted under 35 U.S.C. 154(b) by 0 days.

(21) Appl. No.: 17/797,576

(22) PCT Filed: Jan. 13, 2021

(86) PCT No.: PCT/JP2021/000790

§ 371 (c)(1),
(2) Date: Aug. 4, 2022

(87) PCT Pub. No.: WO2021/176849

PCT Pub. Date: Sep. 10, 2021

(65) Prior Publication Data

US 2023/0058251 A1 Feb. 23, 2023

(30) Foreign Application Priority Data

Mar. 6, 2020 (JP) ..... 2020-038386

(51) Int. Cl.
*B22D 17/20* (2006.01)

(52) U.S. Cl.
CPC ..... *B22D 17/2023* (2013.01)

(58) Field of Classification Search
CPC ..... B22D 17/2023; B22D 17/2038
See application file for complete search history.

(56) References Cited

U.S. PATENT DOCUMENTS 3,516,480 A * 6/1970 Woltering ..... B22D 17/2023 164/312
6,378,597 B1 * 4/2002 Zecman ..... B22D 17/2023 164/113

(Continued)

FOREIGN PATENT DOCUMENTS

JP 56-163068 A 12/1981
JP H02-123351 U 10/1990

(Continued)

OTHER PUBLICATIONS

Machine Translation of Soeda et al (JP H05-261507A, published Oct. 12, 1993, cited in IDS filed Aug. 4, 2022). (Year: 1993).*

(Continued)

*Primary Examiner* — Kevin E Yoon
*Assistant Examiner* — Jacky Yuen
(74) *Attorney, Agent, or Firm* — Kenichiro Yoshida

(57) ABSTRACT

A die casting sleeve, supported horizontally on a die casting device such that a cylinder portion front end communicates with a cavity and a plunger tip is inserted from a cylinder portion rear end, is configured such that the cylinder portion has a double structure in which an inner cylinder is fitted into an outer cylinder, the inner cylinder is made of a composite material of titanium or a titanium alloy and ceramic in at least a molten metal receiving region under an inlet port, a first planar portion is formed on the outer cylinder in the molten metal receiving region, and a cooling device including a tubular portion for letting a cooling medium flow in a jacket main body as a metal block having a second planar portion is mounted on the outer cylinder in a state where the second planar portion abuts against the first planar portion.

4 Claims, 4 Drawing Sheets

(56) References Cited

U.S. PATENT DOCUMENTS

| | | | | |
|---|---|---|---|---|
| 2011/0011900 | A1* | 1/2011 | Fischer | B22D 17/2023 222/596 |
| 2022/0161319 | A1* | 5/2022 | Cerutti | C22C 33/003 |

FOREIGN PATENT DOCUMENTS

| | | | |
|---|---|---|---|
| JP | H03-142053 | A | 6/1991 |
| JP | H03-116253 | U | 12/1991 |
| JP | H05-261507 | A | 10/1993 |
| JP | H10-328804 | A | 12/1998 |
| JP | 2000-084653 | A | 3/2000 |
| JP | 2000-334555 | A | 12/2000 |
| JP | 2000-351054 | A | 12/2000 |
| JP | 2004-291089 | A | 10/2004 |
| JP | 2005-034867 | A | 2/2005 |
| JP | 2013-202647 | A | 10/2013 |
| WO | 2021/176849 | A1 | 9/2021 |

OTHER PUBLICATIONS

Machine Translation of Masuda (JP 2000-351054 A, published Dec. 19, 2000, cited in IDS filed Aug. 4, 2022). (Year: 2000).*

* cited by examiner

INSTALLATION STRUCTURE FOR DIE CASTING SLEEVE, AND DIE CASTING SLEEVE

BACKGROUND OF THE INVENTION

Field of the Invention

The present invention relates to an installation structure for a die casting sleeve and the die casting sleeve.

Description of the Related Art

A cylindrical sleeve for filling a cavity with molten metal is used for die casting of non-ferrous metal such as aluminum, magnesium, zinc, tin, lead, and alloys thereof. One end of the sleeve communicates with the cavity, and a plunger tip is inserted from the other end thereof and is slid in the axial direction in the sleeve. A horizontal (horizontally injection-type) sleeve that is used while the axial direction thereof is substantially horizontal has an inlet hole penetrating through a part of a side peripheral wall of the sleeve, which is provided so as to be opened upward in the vicinity of an end portion on the side where the plunger tip is inserted. The molten metal supplied into the sleeve through the inlet port is pressure-fed in the sleeve with forward traveling of the plunger tip to fill the cavity.

Conventionally, although a general sleeve is made of steel, there has been a problem that the sleeve made of steel tends to erode due to contact with the molten metal as a filling target and a durability thereof is short because the non-ferrous metal is easy to react with iron. Furthermore, since steel has high heat conductivity, the temperature of the molten metal supplied into the sleeve is easy to be lowered. When the temperature of the molten metal supplied into the sleeve is lowered in the sleeve before the molten metal reaches the cavity to generate solidified pieces and the solidified pieces are mixed into a product after molding, defects such as stripping tend to be caused in corresponding portions of the product, resulting in a problem that mechanical strength is lowered.

The present applicant has therefore proposed that a sleeve is configured to have a double structure with an outer cylinder and an inner cylinder and the inner cylinder to be fitted into the outer cylinder made of steel is formed by a sintered body (hereinafter, referred to as a "TC composite material") made of a composite material of titanium or a titanium alloy and ceramic for implementation (for example, see, Japanese Patent Application Laid-open Publication No. 3-142053). The TC composite material has low reactivity with non-ferrous metal and is therefore excellent in erosion resistance. Although the heat conductivity of steel (SKD61) is as high as 35.6 W/mK, the heat conductivity of the TC composite material is as extremely low as 7.4 W/mK and is excellent in heat retention. Therefore, the TC composite material has an advantage that the temperature of the molten metal supplied into the sleeve is unlikely to be lowered. Furthermore, when the inner cylinder is made of only ceramic, the erosion resistance and the heat retention can be enhanced whereas ceramic as a brittle material has such a disadvantage that it is low in impact resistance. On the other hand, the TC composite material is the composite material of metal and ceramic and therefore has an advantage that it is excellent in the impact resistance as well.

The sleeve using the TC composite material excellent in the erosion resistance, the heat retention, and the impact resistance for the inner cylinder has advantages that the durability thereof is longer than that of the conventional sleeve and a product with high quality in which no solidified piece is mixed can be molded. However, when the supply amount of molten metal to the sleeve is increased for casting of a larger-sized product or when a time interval of supply of the molten metal to the sleeve is shortened in order to speed up a casting cycle, solidified molten metal can adhere to the inner surface of the inner cylinder. When the solidified molten metal adheres, such resistance that the plunger tip climbs over the adhered substances, and makes strong contact with an opposing face of the inner surface of the inner cylinder, which is so-called "scuffing", is generated or the inner surface of the inner cylinder is stripped off together with the adhered substances, resulting in a problem that the durability of the sleeve is shortened.

Patent Document 1: Japanese Patent Application Laid-open Publication No. 3-142053

SUMMARY OF THE INVENTION

In view of the above-described circumferences, an object of the present invention is to provide an installation structure for a die casting sleeve in which the die casting sleeve is supported on a die casting device, the die casting sleeve having long durability even when it is used under a condition of a large supply amount of molten metal or a condition of a short time interval of supply of the molten metal, and the die casting sleeve.

In order to achieve the above-mentioned object, an installation structure for a die casting sleeve (hereinafter, also referred to as a "sleeve" simply) according to an aspect of the present invention is "an installation structure for a die casting sleeve in which the die casting sleeve including a cylinder portion having a cylindrical shape and an inlet port penetrating through a part of a side peripheral wall of the cylinder portion is supported on a die casting device such that a cylinder portion front end communicates with a cavity and a plunger tip is inserted from a cylinder portion rear end in a state where a center axis of the cylinder portion is substantially horizontal and the inlet port is opened upward, wherein the cylinder portion has an outer cylinder and an inner cylinder fitted into the outer cylinder, the inner cylinder is formed by a sintered body made of a composite material of titanium or a titanium alloy and ceramic in at least a molten metal receiving region as a portion for receiving molten metal supplied through the inlet port in the cylinder portion, a first planar portion is formed on the outer cylinder in the molten metal receiving region, and a cooling device including a tubular portion for letting a cooling medium flow in a jacket main body as a metal block having a second planar portion is mounted on the outer cylinder in a state where the second planar portion directly abuts against the first planar portion or a state where the second planar portion indirectly abuts against the first planar portion with either of a graphite sheet or a metal foil interposed."

As described above, when the sleeve is used under the condition of the increased supply amount of molten metal into the sleeve or the condition of the short time interval of supply of the molten metal, the solidified molten metal adheres to the inner surface of the inner cylinder made of the TC composite material. Such adhesion of the molten metal has been significant in the molten metal receiving region as the portion for receiving the molten metal. When the inner cylinder was examined after the adhered substances were melted and removed, states where the inner surface of the inner cylinder was gouged in the portion, and further, a large number of fine cracks were generated around the portion were observed. Furthermore, in a die casting test that was performed while measuring the temperature of the inner surface of the inner cylinder made of the TC composite material, when die casting was repeated the several number of times, the temperature of the molten metal receiving region on the inner surface of the inner cylinder was increased to about 500° C. under the molding conditions where the above-described adhesion of the molten metal occurred. The mechanical strength (bending strength) of steel is drastically lowered with increase in temperature. By contrast, the TC composite material has advantages that the mechanical strength thereof is not drastically lowered with increase in temperature and is higher than that of steel at temperatures of equal to or higher than about 600° C. The mechanical strength of the TC composite material is however gradually lowered at temperatures of higher than 500° C.

The following has been considered. That is, the TC composite material tends to accumulate heat because it has a characteristic of low heat conductivity, and the temperature of the inner cylinder is increased to 500° C. causing the mechanical strength to be lowered with increase in the supply amount of molten metal or decrease in the time interval of supply of the molten metal. Fine cracks are generated on the surface of the TC composite material used for the inner cylinder due to repeated heating and cooling by supply and injection of the molten metal under the above-mentioned condition. Furthermore, it has been considered that damage of the inner surface of the inner cylinder progresses in a process where the high-temperature molten metal enters the fine cracks to further progress erosion and the molten metal remaining at the cracks is solidified and adheres thereto.

When the damage of the inner cylinder made of the TC composite material progresses in such a process, it can be supposed that the "inner cylinder" is cooled in order to prevent the temperature of the inner cylinder from being increased. However, when the inner cylinder is cooled to lower the temperature of the molten metal before the molten metal reaches the cavity, solidified pieces are generated and mixed into a product after molding, resulting in deterioration in quality of the product.

In order to balance these conflicting desires, the aspect of the present invention employs a means in which "although it is the inner cylinder made of the TC composite material that is damaged, not the inner cylinder but the outer cylinder on the outer side of the inner cylinder is cooled to indirectly cool the inner cylinder" and a means in which "the molten metal receiving region is cooled as a minimum range to be cooled". That is to say, employed is a means in which the inner cylinder is made of the TC composite material in at least the molten metal receiving region and the cooling device is provided on the outer side of the inner cylinder in the molten metal receiving region. Since the TC composite material has extremely low heat conductivity, when it is cooled from the outer side thereof, the TC composite material itself is cooled to some extent but the molten metal is not cooled, and the temperature of the molten metal can be prevented from being lowered. The progress of the damage of the inner cylinder in the above-mentioned process can be suppressed because the TC composite material itself is cooled, thereby increasing the durability of the sleeve.

The horizontal sleeve that is used while the axial direction is substantially horizontal conventionally has the following problem. That is, the cylinder portion rear end on which the plunger tip is inserted as the end portion on the side on which the inlet port is provided is deformed so as to warp upward. Such a problem similarly occurs in the above-mentioned sleeve (Patent Document 1) including the inner cylinder made of the TC composite material. The upward warp of the cylinder portion rear end causes a trouble of "scuffing" in which the plunger tip makes strong contact with an upper portion of the inner surface similarly to the above-mentioned case where the plunger tip climbs over the solidified molten metal. It is considered that the above-mentioned deformation of the upward warp of the cylinder portion rear end occurs for the following reason. That is, the molten metal receiving region is extremely increased in temperature with supply of the molten metal through the inlet port to thermally expand largely and extend largely also in the axial direction of the cylinder portion whereas the peripheral edge portion of the inlet port is not so increased in temperature to thermally expand to a small degree and less extend in the axial direction.

In the aspect of the present invention, the cooling device is mounted on the outer cylinder in the molten metal receiving region that is extremely increased in temperature with supply of the molten metal to indirectly cool the TC composite material in the molten metal receiving region. The "scuffing resistance" caused by the above-mentioned unbalance of the thermal expansion can thereby be suppressed effectively.

As a means for cooling the cylinder portion from the outer side, it can be supposed that a cooling jacket 400 is mounted on a cylinder portion 100 as illustrated in FIG. 5A and FIG. 5B. The cooling jacket 400 has a configuration in which a pipe 450 for letting a cooing medium flow is installed in a jacket main body 410 surrounding the cylinder portion 100 from the outer side and made of metal, and includes a belt 470 for winding and fixing the jacket main body 410 around the cylinder portion 100. The cooling jacket 400 surrounds the cylinder portion 100 from the outer side and is therefore bulky necessarily and increased in weight. The cylinder portion 100 of a die casting sleeve generally is a cylinder having a cross-sectional circular shape. Accordingly, the jacket main body 410 is formed to have a circular arc-shaped cross section along the outer shape of the cylinder portion 100, a large mass of a metal material is cut. This causes problems that troublesome tasks are required for processing, cost is increased, and the metal material of cut chips are largely wasted.

By contrast, according to the aspect of the present invention, the planar portion is formed on the outer cylinder whereas the cooling device is configured to include the tubular portion provided in the jacket main body as the metal block having the planar portion, and the planar portion (second planar portion) of the cooling device is caused to directly or indirectly abut against the planar portion (first planar portion) of the outer cylinder. Therefore, the cooling device can be reduced in size without largely projecting from the cylinder portion and can be reduced in weight. The jacket main body as the metal block having the planar portion can have a simple shape such as a rectangular parallelepiped shape and can therefore be produced using a generic metal material at low cost without requiring complicated processing.

In addition, when the jacket main body having the circular arc-shaped cross section is processed along the cylinder portion having the cylindrical shape, it is difficult to process the jacket main body such that both the outer surface of the cylinder portion and the inner surface of the jacket main body are brought into close contact with each other over the entire surface because both the surfaces are curved. For this reason, contact between the cooling device and the cylinder portion is not preferable to arise a risk that cooling efficiency of the sleeve by the cooling device is low. On the other hand, according to the aspect of the present invention, the outer cylinder and the cooling device abut against each other via the planar portion (first planar portion) and the planar portion (second planar portion), thereby easily enhancing the contactness and increasing the cooling efficiency of the sleeve by the cooling device.

As a configuration for causing the planar portion (first planar portion) of the outer cylinder and the planar portion (second planar portion) of the cooling device to indirectly abut against each other, a configuration in which a sheet material having high heat conductivity is interposed therebetween can be employed. A graphite sheet, which will be described later, or a metal foil such as a copper foil, a silver foil, and an aluminum foil can be used as the sheet material.

As the means for cooling the inner cylinder from the outer side, it can also be supposed that the tubular portion for letting the cooling medium flow is provided "in the outer cylinder". In this case, processing when the thickness of the outer cylinder is small can be difficult. On the other hand, in the aspect of the present invention, the planar portion (first planar portion) is formed in the molten metal receiving region of the outer cylinder, and the cooling device is externally mounted thereon. With this configuration, the die casting sleeve can include the cooling device with no problem even when the thickness of the outer cylinder is small.

The installation structure for the die casting sleeve in the aspect of the present invention can have a configuration in which "the cooling device is mounted on the outer cylinder in a state where the graphite sheet is interposed between the second planar portion and the first planar portion", in addition to the above-mentioned configuration.

The graphite sheet has flexibility and softness. Accordingly, even if the planar portion (first planar portion) of the outer cylinder and the planar portion (second planar portion) of the cooling device are not smooth surfaces like mirror-polished surfaces, the graphite sheet interposed therebetween is brought into close contact with each of the planar portions. The graphite sheet is excellent in heat conductivity, and the cooling device can thereby cool the outer cylinder efficiently via the graphite sheet brought into close contact with each of the planar portions. Eventually, the inner cylinder can be indirectly cooled effectively.

The installation structure for the die casting sleeve in the aspect of the present invention can have a configuration in which "the cooling device is provided at a position deviating to one side such that an angle formed by a line connecting a center line of the cooling device and the center axis of the cylinder portion and a vertical line from a center of the inlet port is 10 degrees to 60 degrees to an opposite side to a ladle for supplying the molten metal to the inlet port on a cross section orthogonal to the center axis of the cylinder portion", in addition to the above-mentioned configuration.

It has been conventionally considered that a portion increased in temperature due to supply of the molten metal on the inner surface of the sleeve is located just under the inlet port. As for this point, the present inventors have found, as a result of careful analysis on the damaged portion in the sleeve, that the damaged portion not only is located just under the inlet port but also reaches a position deviating to one side from the vertical line from the center of the inlet port. This has been considered to occur because a general die casting device has mechanical restrictions on operations of a ladle for supplying molten metal to an inlet port and the molten metal is thereby supplied from the obliquely upper side of the inlet port, as details thereof will be described later.

With this configuration, the cooling device mounted on the outer cylinder can cool the portion of the cylinder portion, which receives the molten metal supplied to the inlet port from the obliquely upper side by the ladle and is increased in temperature. The action of indirectly cooling the inner cylinder by cooling the outer cylinder can therefore be exerted more effectively.

Next, a die casting sleeve according to another aspect of the present invention is "a die casting sleeve including a cylinder portion having a cylindrical shape and an inlet port penetrating through a part of a side peripheral wall of the cylinder portion, wherein the cylinder portion has an outer cylinder and an inner cylinder fitted into the outer cylinder, the inner cylinder is formed by a sintered body made of a composite material of titanium or a titanium alloy and ceramic in at least a molten metal receiving region including a portion facing the inlet port in the cylinder portion, a first planar portion is formed on the outer cylinder in the molten metal receiving region, and a cooling device including a tubular portion for letting a cooling medium flow in a jacket main body as a metal block having a second planar portion is mounted on the outer cylinder in a state where the second planar portion directly abuts against the first planar portion or a state where the second planar portion indirectly abuts against the first planar portion with either of a graphite sheet or a metal foil interposed."

This is the configuration of the die casting sleeve that is used for the above-mentioned installation structure.

As described above, the present invention can provide the installation structure for the die casting sleeve in which the die casting sleeve is supported on the die casting device, the die casting sleeve having long durability even when it is used under the condition of the large supply amount of molten metal or the condition of the short time interval of supply of the molten metal, and the die casting sleeve.

DESCRIPTION OF THE EMBODIMENTS

Figure 3:
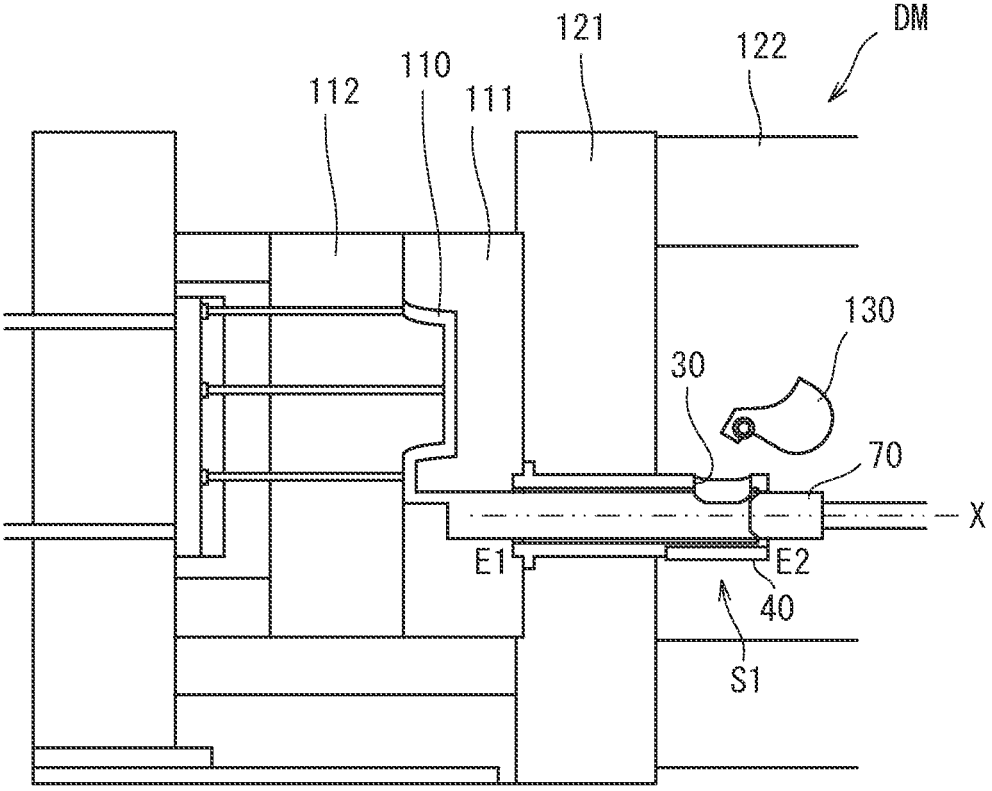
FIG. 3 is a configuration view illustrating a main part of a general die casting device.

Hereinafter, a specific embodiment of the present invention will be described with reference to the drawings. A sleeve S1 includes a cylinder portion 1 having a cylindrical shape and an inlet port 30 penetrating through a part of a side peripheral wall of the cylinder portion 1. As illustrated in FIG. 3, the sleeve S1 is supported in a cold chamber die casting device DM in a state where a center axis X of the cylinder portion 1 is substantially horizontal and the inlet port 30 is opened upward. A cylinder portion front end El of the sleeve S1 communicates with a cavity 110 formed between a fixed mold 111 and a movable mold 112, and a plunger tip 70 is inserted from a cylinder portion rear end E2. Molten metal stored in a holding furnace is supplied to the inlet port 30 through a ladle 130.

As illustrated in Fig. 1A to FIG. 1D, the cylinder portion 1 of the sleeve S1 has an outer cylinder 20 and an inner cylinder 10 fitted into the outer cylinder 20. A molten metal receiving region is a region for receiving the molten metal supplied through the inlet port 30. The inner cylinder 10 is made of a TC composite material (sintered body made of a composite material of titanium or a titanium alloy and ceramic) in at least the molten metal receiving region. In the embodiment, the whole inner cylinder 10 including the molten metal receiving region is made of the TC composite material. The TC composite material is manufactured by powder metallurgy and can be provided by sintering, under a non-oxidizing atmosphere, a molded green body molded using a raw material obtained by mixing titanium powder and silicon carbide powder. The raw material of the TC composite material can contain powder of another metal such as nickel.

Figure 1A:
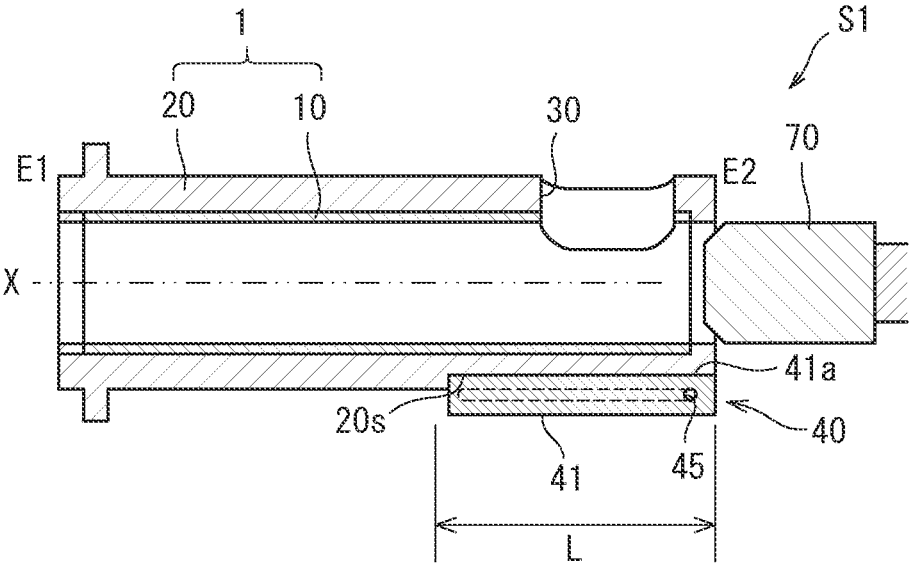
FIG. 1A is a cross-sectional view when a sleeve as an embodiment of the present invention is cut at the center in the direction of a center axis.
Figure 1B:
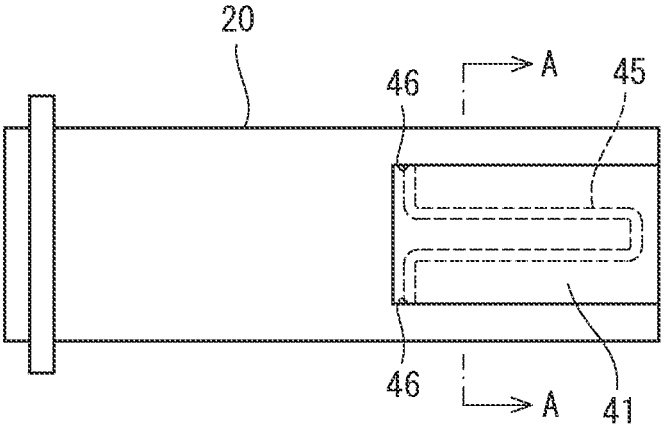
FIG. 1B is a bottom view of the sleeve.
Figure 1C:
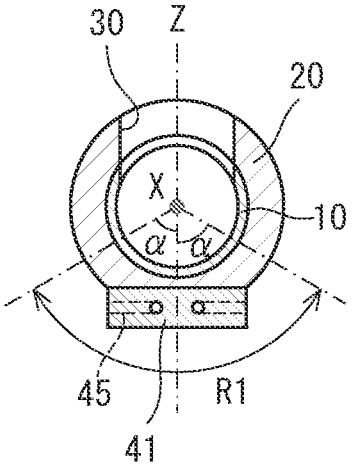
FIG. 1C is a cross-sectional view of the sleeve when cut along line A-A.
Figure 1D:
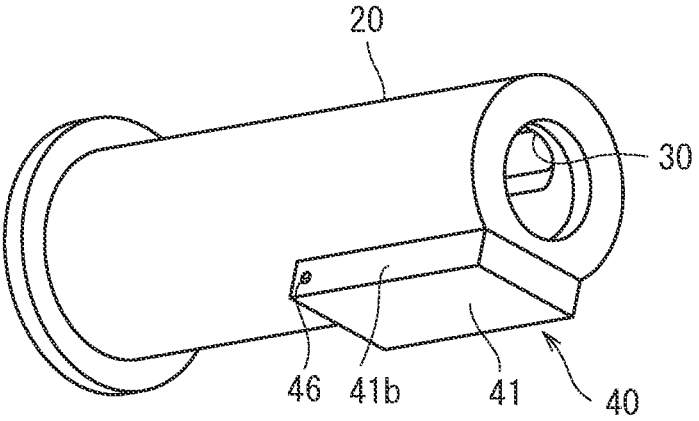
FIG. 1D is a perspective view of the sleeve when viewed from the bottom surface side.

The molten metal receiving region is a region that is increased in temperature when the molten metal is supplied through the inlet port 30. As illustrated in FIG. 1A, the molten metal receiving region in the direction parallel with the center axis X can be a range L from the cylinder portion rear end E2 to the length of twice the diameter of the inlet port 30. As illustrated in FIG. 10, the molten metal receiving region on the cross section orthogonal to the center axis X can be a range R1 indicated by a circular arc having a center angle $\alpha$ of 60 degrees to each of both sides from a vertical line Z from the center of the inlet port 30.

Figure 2A:
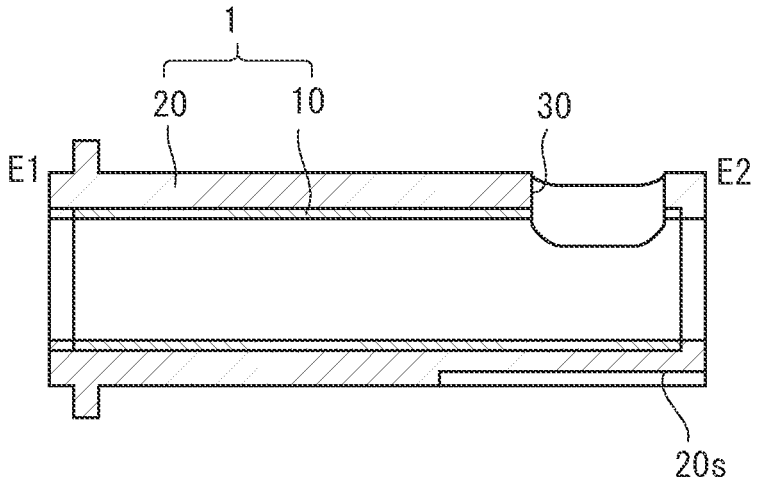
FIG. 2A and FIG. 2B are views for explaining manufacturing of the sleeve in FIG. 1A to 1D.
Figure 2B:
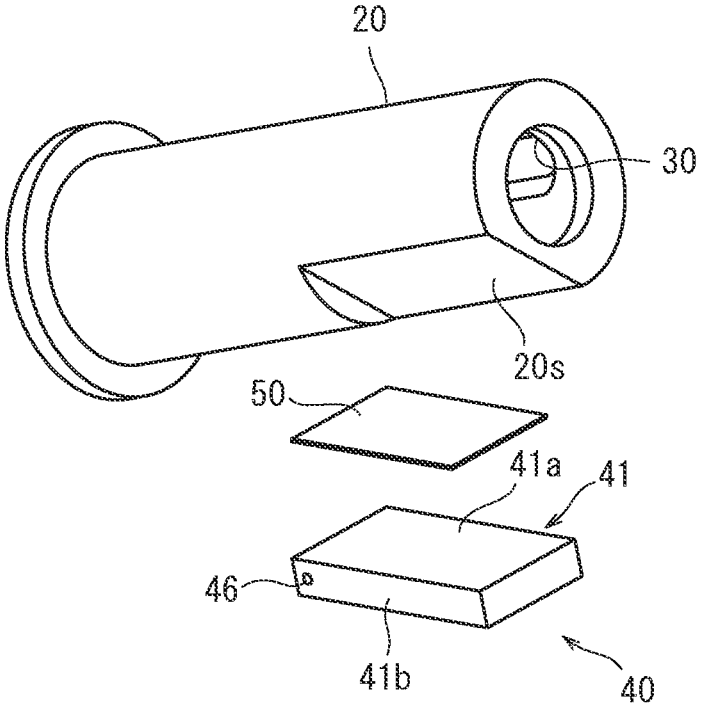

As illustrated in FIG. 2A and FIG. 2B, the outer cylinder 20 has a planar portion 20*s* formed in the molten metal receiving region, and a cooling device 40 is mounted on the planar portion 20*s*. The cooling device 40 is configured by providing a tubular portion 45 for letting a cooling medium flow in a jacket main body 41 as a metal block such as copper and aluminum having high heat conductivity. The jacket main body 41 has a flat substantially rectangular parallelepiped shape, and one of a pair of planar portions 41*a* having the largest areas abuts against the planar portion 20*s* of the outer cylinder 20. The tubular portion 45 has a substantially U shape, and both ends thereof respectively reach a pair of side surface portions 41*b* perpendicular to the pair of planar portions 41*a* to form openings 46. The cooling medium supplied through one of the openings 46 flows through the inside of the tubular portion 45 and is discharged through the other of the openings 46. With heat exchange of the cooling medium flowing through the inside of the tubular portion 45 with the outer cylinder 20 increased in temperature, the outer cylinder 20 is cooled and the inner cylinder 10 is indirectly cooled. Water, the air, or oil can be used as the cooling medium. The planar portion 20*s* of the outer cylinder 20 corresponds to a "first planar portion" according to the present invention, and the planar portion 41*a* of the cooling device 40 corresponds to a "second planar portion" according to the present invention.

The tubular portion 45 can be formed into not the substantially U shape as described above but a zigzag shape or a linear shape.

FIG. 1A to 1D illustrate the case where the cooling device 40 is mounted on the outer cylinder 20 in a state where the planar portion 41*a* directly abuts against the planar portion 20*s* of the outer cylinder 20. Preferable adhesion is provided because the planar portions (the planar portion 41*a* and the planar portion 20*s*) abut against each other, so that the cooling device 40 can cool the outer cylinder 20 efficiently, and eventually, can indirectly cool the inner cylinder 10 efficiently.

A graphite sheet 50 may be interposed between the planar portion 41*a* of the cooling device 40 and the planar portion 20*s* of the outer cylinder 20, as illustrated in FIG. 2B. Since the graphite sheet 50 has flexibility and softness, the graphite sheet is brought into close contact with each of the planar portions 20*s* and 41*a* even if the planar portion 20*s* and the planar portion 41*a* are not smooth surfaces like mirror-polished surfaces. The cooling device 40 and the outer cylinder 20 can be brought into close contact with each other by heat conduction through the graphite sheet excellent in heat conductivity interposed therebetween.

The cooling device 40 can be mounted on the outer cylinder 20 in the molten metal receiving region not at a position just under the inlet port 30 but at a position deviating to one side from the vertical line Z from the center of the inlet port 30. The mounting manner is based on the finding that the portion of the inner surface of the cylinder portion, which is damaged due to supply of the molten metal to the sleeve, not only is located just under the inlet port as considered by those skilled in the art so far but also reaches the position deviating to one side.

Figure 4:
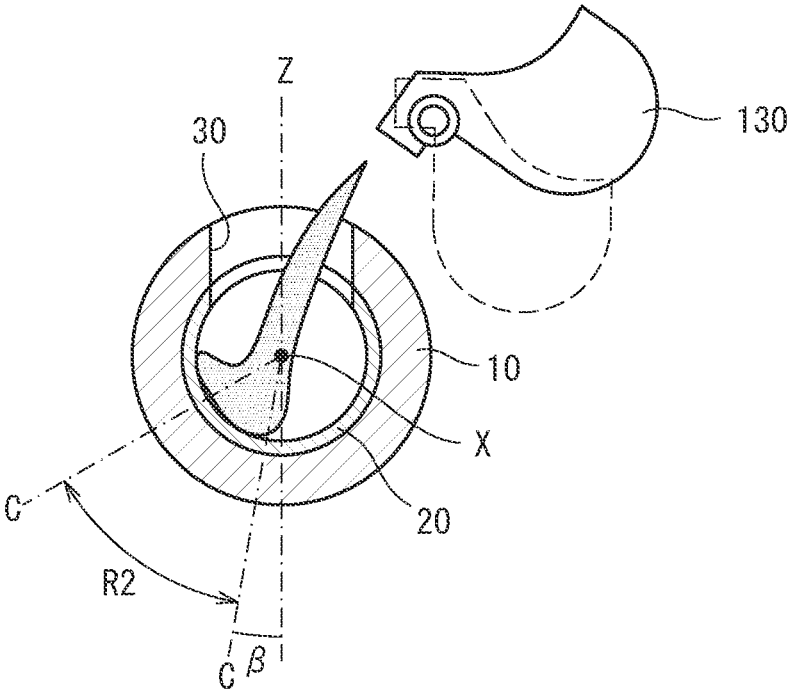
FIG. 4 is a view schematically illustrating supply of molten metal to a sleeve from a ladle in the general die casting device.
Figure 5A:
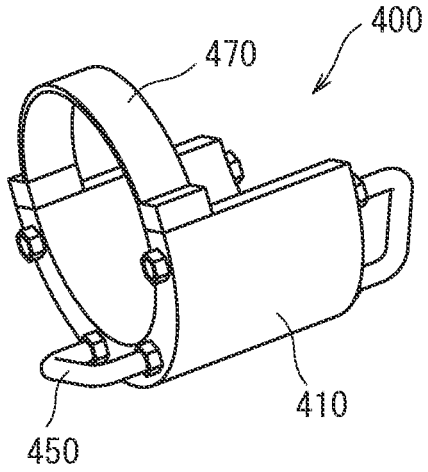
Fig. 5A Prior Art
FIG. 5A is a perspective view of a cooling jacket that is compared with the present invention.
Figure 5B:
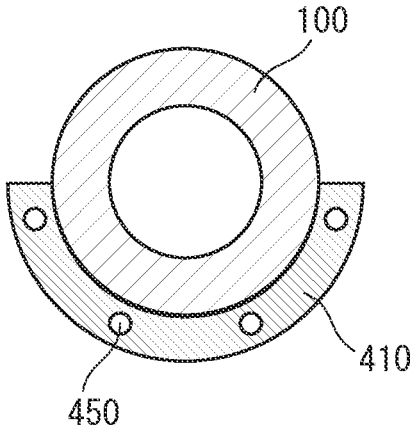
Fig. 5B Prior Art
FIG. 5B is a cross-sectional view in a state where the cooling jacket in FIG. 5A is mounted on a conventional sleeve.

As a reason for this, as illustrated in FIG. 3, a position at which the inlet port 30 is opened in the general die casting device DM is considered to be in the vicinity of a fixing platen 121 supporting the fixed mold 111 configuring a metal mold, a frame 122 for supporting a drive device (not illustrated) for driving the plunger tip 70 on the fixing platen 121, and the like. A device (not illustrated) moving the ladle 130 for pouring the molten metal to the inlet port 30 therefore interferes with the fixing platen 121 and the frame 122. Accordingly, it is difficult to move the ladle 130 to the position just above the inlet port 30, and as schematically illustrated in FIG. 4, the molten metal is poured to the inlet port 30 from the obliquely upper side with tilting of the ladle 130. As a result, the temperature of the inner surface of the cylinder portion 1 is the highest at not the position just under the inlet port 30 but the portion deviating to one side from the vertical line Z, and the portion tends to be damaged.

In consideration of this, the position of the cooling device 40 can be set such that an angle $\beta$ formed by a line connecting a center line C of the cooling device 40 and the center axis X of the cylinder portion 1 and the vertical line Z from the inlet port 30 is 0 degrees to 60 degrees to one side on a cross section orthogonal to the center axis X, as illustrated in FIG. 4. More desirably, the center line of the cooling device 40 is set in a range R2 where the angle $\beta$ is 0 degrees to 60 degrees to one side.

With the sleeve S1 in the embodiment, the material of the inner cylinder 10 is set to the TC composite material in at least the molten metal receiving region increased in temperature when the molten metal is supplied, and the cooling device 40 cools the outer cylinder 20 in the molten metal receiving region, that is, the inner cylinder 10 made of the TC composite material having low heat conductivity is indirectly cooled from the outer side to thereby cool the TC composite material to some extent that the temperature of the molten metal is not lowered. Therefore, damage of the inner cylinder can be effectively suppressed while suppressing generation of solidified pieces, thereby increasing the durability of the sleeve.

The cooling device 40 is mounted on the planar portion 20*s* formed on the outer cylinder 20, so that the cooling device 40 can be prevented from largely projecting from the cylinder portion 1 to achieve a compact structure reduced in weight. Furthermore, the jacket main body 41 as the metal block has the flat rectangular parallelepiped shape including the pair of planar portions 41*a*. Therefore, processing is easier than that in the case of a jacket main body having a circular arc-shaped cross section so as to externally surround the cylinder portion 1, and processing of providing the tubular portion 45 in the jacket main body 41 is also easy.

Moreover, the outer cylinder 20 and the cooling device 40 make contact with each other with abutment between the planar portion 20*s* and the planar portion 41*a*, thereby easily enhancing the adhesion and increasing the cooling efficiency of the outer cylinder 20 by the cooling device 40. In addition, when the graphite sheet 50 is interposed between the planar portion 20*s* and the planar portion 41*a*, the planar portion 20*s* and the planar portion 41*a* can be brought into close contact with each other by heat conduction through the graphite sheet 50 interposed therebetween even if the smoothness of the planar portion 20*s* and the planar portion 41*a* is not so high, and the cooling device 40 can cool the outer cylinder 20 more efficiently. The cooling device 40 can cool the outer cylinder 20 efficiently, so that the inner cylinder 10 can be indirectly cooled from the outer side effectively.

Furthermore, the planar portion 20*s* is formed on the outer cylinder 20, and the cooling device 40 is externally mounted thereon. With this configuration, the sleeve S1 can include the cooling device 40 with no problem even when the thickness of the outer cylinder 20 is small unlike the case where the tubular portion is provided in the outer cylinder.

Hereinbefore, the present invention has been explained using the preferred embodiment. The present invention is not however limited to the above-mentioned embodiment, and various improvements and changes in design can be made in a range without departing from the aspect of the present invention, as will be described below.

For example, a surface treatment layer by surface treatment such as nitriding treatment, carbonization treatment, and boride treatment can be provided on the inner surface of the inner cylinder 10.

Silicon carbide (SiC) is exemplified as the ceramic as the raw material of the TC composite material in the above description. The ceramic is however not limited thereto, and nitride-based ceramic such as $Si_3N_4$, TiN, and ALN, carbide-based ceramic such as TiC, $B_4C$, and $Crc_2$, boride-based ceramic such as $ZrB_2$ and $TiB_2$, oxide-based ceramic such as $Cr_2O_3$, $Tio_2$, $ZrO_2$, MgO, and $Y_2O_3$, or sialon can be used alone or some of them can be mixed and used.

Furthermore, the entire inner cylinder 10 is made of the TC composite material as the example in the above description. A peripheral edge portion of the inlet port 30 in the inner cylinder 10 can be made of steel. When the molten metal receiving region is extremely increased in temperature when the molten metal is supplied through the inlet port 30 whereas the liquid level of the molten metal does not reach an upper portion of the inner surface of the inner cylinder at a time point when the molten metal is supplied through the inlet port. Therefore, the peripheral edge portion of the inlet port is not so increased in temperature. As a result, the molten metal receiving region extremely increased in temperature thermally expands largely and extends largely also in the axial direction of the cylinder portion whereas the facing peripheral edge portion of the inlet port thermally expands to a small degree and less extends in the axial direction. An end portion of the sleeve on the inlet port side therefore tends to be deformed so as to warp upward.

In consideration thereof, thermal expansion in the molten metal receiving region and thermal expansion in the peripheral edge portion of the inlet port can be balanced more effectively by mounting the cooling device 40 on the outer cylinder 20 to cool the molten metal receiving region and forming the peripheral edge portion of the inlet port with steel having high heat conductivity, thereby suppressing deformation of upward warpage of the end portion on the inlet port side more effectively.

What is clamed is:

1. An installation structure, comprising:

a die casting device including a cavity and a plunger tip; and a die casting sleeve, wherein the die casting sleeve further comprising:

a cylinder portion having a cylindrical shape with a side peripheral wall, a cylinder portion front end and a cylinder portion rear end; and an inlet port penetrating through a part of the side peripheral wall of the cylinder portion is supported on the die casting device such that the cylinder portion front end communicates with the cavity and the plunger tip is inserted from the cylinder portion rear end in a state where a center axis of the cylinder portion is substantially horizontal and the inlet port is opened upward, wherein the cylinder portion also further comprising:

an outer cylinder; and an inner cylinder fitted into the outer cylinder;

wherein the inner cylinder is formed by a sintered body made of a composite material of titanium and ceramic or a composite material of a titanium alloy and ceramic in at least a molten metal receiving region as a portion for receiving molten metal supplied through the inlet port in the cylinder portion, a first planar portion formed on the outer cylinder in the molten metal receiving region, and a cooling device including a jacket main body and an inner tubular portion for letting a cooling medium flow in the jacket main body as a metal block having a second planar portion is mounted on the outer cylinder in a state where the second planar portion directly abuts against the first planar portion or a state where the second planar portion indirectly abuts against the first planar portion with either of a graphite sheet or a metal foil interposed.

2. The installation structure for the die casting sleeve according to claim 1, wherein the cooling device is mounted on the outer cylinder in a state where the graphite sheet is interposed between the second planar portion and the first planar portion.

3. The installation structure for the die casting sleeve according to claim 1, wherein the cooling device is provided at a position deviating to one side such that an angle formed by a line connecting a center line of the cooling device and the center axis of the cylinder portion and a vertical line from a center of the inlet port is 10 degrees to 60 degrees to an opposite side to a ladle for supplying the molten metal to the inlet port on a cross section orthogonal to the center axis of the cylinder portion.

4. A die casting sleeve including a cylinder portion having a cylindrical shape and an inlet port penetrating through a part of a side peripheral wall of the cylinder portion, wherein the cylinder portion has an outer cylinder and an inner cylinder fitted into the outer cylinder, the inner cylinder is formed by a sintered body made of a composite material of titanium or a titanium alloy and ceramic in at least a molten metal receiving region including a portion facing the inlet port in the cylinder portion, a first planar portion is formed on the outer cylinder in the molten metal receiving region, and a cooling device including a tubular portion for letting a cooling medium flow in a jacket main body as a metal block having a second planar portion is mounted on the outer cylinder in a state where the second planar portion directly abuts against the first planar portion or a state where the second planar portion indirectly abuts against the first planar portion with either of a graphite sheet or a metal foil interposed.

* * * * *